US011098672B2

(12) United States Patent
Yang et al.

(10) Patent No.: US 11,098,672 B2
(45) Date of Patent: Aug. 24, 2021

(54) COATED CYLINDER LINER

(71) Applicant: GM GLOBAL TECHNOLOGY OPERATIONS LLC, Detroit, MI (US)

(72) Inventors: Jianghuai Yang, Rochester Hills, MI (US); Qigui Wang, Rochester Hills, MI (US); Dale A. Gerard, Bloomfield Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/539,269

(22) Filed: Aug. 13, 2019

(65) Prior Publication Data

US 2021/0047981 A1 Feb. 18, 2021

(51) Int. Cl.

| | |
|---|---|
| ***F02F 1/10*** | (2006.01) |
| ***F02F 1/00*** | (2006.01) |
| ***F02F 1/08*** | (2006.01) |

(52) U.S. Cl.

CPC ..... *F02F 1/102* (2013.01); *F02F 1/004* (2013.01); *F02F 1/08* (2013.01); *F02F 2200/06* (2013.01)

(58) Field of Classification Search

CPC ..... F02F 1/102; F02F 1/004; F02F 1/08
See application file for complete search history.

(56) References Cited

U.S. PATENT DOCUMENTS

| | | | | |
|---|---|---|---|---|
| 2,774,686 | A | 12/1956 | Hodge | |
| 4,081,984 | A | 4/1978 | Gustafsson et al. | |
| 4,706,616 | A | 11/1987 | Yoshimitsu | |
| 5,183,025 | A | 2/1993 | Jorstad et al. | |
| 5,232,041 | A | 8/1993 | Kuhn | |
| 5,333,668 | A | 8/1994 | Jorstad et al. | |
| 5,671,532 | A | 9/1997 | Rao et al. | |
| 6,443,211 | B1 * | 9/2002 | Myers | B22D 19/08 164/100 |
| 6,508,240 | B1 | 1/2003 | Bedwell et al. | |
| 6,588,408 | B2 | 7/2003 | Bedwell et al. | |
| 8,505,438 | B2 | 8/2013 | Choi et al. | |
| 9,448,126 | B2 | 11/2016 | Bischofberger et al. | |
| 10,247,129 | B2 | 4/2019 | DeGrace et al. | |
| 10,253,721 | B2 | 4/2019 | Wang et al. | |

(Continued)

FOREIGN PATENT DOCUMENTS

| | | | |
|---|---|---|---|
| CN | 106756449 | | 5/2017 |
| JP | 58038653 A | * | 3/1983 |
| KR | 2008060413 A | * | 7/2008 |

OTHER PUBLICATIONS

U.S. Appl. No. 15/956,805, titled Cylinder Liner for Internal Combustion Engine and Method for Making Cylinder Liner, filed Apr. 19, 2018 by GM Global Technology Operations LLC.

(Continued)

*Primary Examiner* — Kevin A Lathers
(74) *Attorney, Agent, or Firm* — Bonnie Shaw

(57) ABSTRACT

A method of forming an engine component includes providing a cylinder liner main body having a curved interior wall forming a cylinder bore extending along a bore axis and a curved exterior wall formed circumferentially about the curved interior wall. The method includes disposing a coating layer onto the interior wall and the exterior wall. A cylinder liner is provided that includes a main body and a coating layer disposed on an exterior wall and on an interior wall of the main body.

8 Claims, 6 Drawing Sheets

(56) References Cited

U.S. PATENT DOCUMENTS

| | | | |
|---|---|---|---|
| 2011/0232478 | A1 | 9/2011 | Horigome et al. |
| 2015/0292053 | A1 | 10/2015 | Xiong et al. |
| 2018/0003125 | A1 | 1/2018 | Aharonov |
| 2018/0057915 | A1 | 3/2018 | Li et al. |
| 2018/0111231 | A1 | 4/2018 | Wang et al. |
| 2019/0032594 | A1 | 1/2019 | Wang et al. |
| 2019/0054556 | A1 | 2/2019 | Li et al. |
| 2019/0103537 | A1 | 4/2019 | Salvador et al. |
| 2019/0170082 | A1 | 6/2019 | Coppola et al. |

OTHER PUBLICATIONS

Y. Tsunekawa et al., "Hot-Dip Coating of Lead-free Aluminum on Steel Substrates with Ultrasonic Vibration," Journal of Material Science Tecnology, 2008, pp. 41-44, vol. 24, No. 1, Nagoya, Japan.

Robert Brooks, "Handling the Heat, and the Pressure, of New Product Development," Foundry Management and Technology, Oct. 2, 2012, pp. 1-12, printed on Aug. 2, 2019, available at https://www.foundrymag.com/moldscores/handling-heat-and-pressure-new-product-development.

* cited by examiner

COATED CYLINDER LINER

FIELD

The present disclosure relates to an engine cylinder liner for an engine bore of an engine block, and a method of forming the same.

INTRODUCTION

During a combustion cycle of an internal combustion engine (ICE), air/fuel mixtures are provided to cylinders within an engine block of the ICE. The air/fuel mixtures are compressed and/or ignited and combusted to provide output drive power via pistons positioned within the cylinders. As the pistons move within the cylinders, friction between the piston and cylinder and the presence of fuel can wear and degrade the cylinder surfaces. Additionally, combustion pressure and piston side loading can pose a significant amount of stress on the cylinder bores.

Historically, ICEs have employed cylinder liners to prevent wear or damage to the engine block, especially when the engine block is formed from an aluminum alloy that may have poor wear resistance. Cylinder liners have been made of various grades of cast iron (e.g., gray iron). Cast iron is selected, in part, for its low production cost, ease of manufacture, satisfactory thermal conductivity, which minimizes bore distortion, and good wear resistance due to the presence of free graphite which allows for lubrication and reduces friction with the piston ring pack.

Cast iron liners may be inserted into an already-cast aluminum engine block (press-in-place cylinder liners), or the cast iron cylinder liners may be placed into an engine block mold and the block material may then be cast around the liner (cast-in-place cylinder liners). The bonding between the cylinder liner and the engine block may be deficient. Poor bonding may result in reduced heat transfer between the liner and the block, a distortion of the cylinder bore, reduced stiffness, and even structural failure such as, for example, cracks developing in the liners and/or engine block material.

In addition to these challenges, shipping and storing of cast iron liners prior to over-casting the block presents its own challenges because cast iron is susceptible to hydrogen contamination, for example, such as moisture absorption and rust. Such contamination prevents adequate bonding of the block to the liner when then block is cast over the liner and also results in casting porosity in the block, such as in the deck face, aluminum bores, and potentially in other locations because the hydrogen in the liner releases gas bubbles to the over-casting block during its mold filling and solidification processes. Therefore, typically, shipping and storing of cast iron liners (prior to casting the aluminum block over the liners) requires VCI bags and desiccants to attempt to keep hydrogen contamination to a minimum.

It is desirable to provide a cylinder liner that is sufficiently adhered or bonded to the cylinder bore engine block substrate which results in a desired heat transfer and cylinder integrity having reduced wear, reduced distortion and reduction or prevention of cracking or other failures, while minimizing shipping costs and complexities.

SUMMARY

The present disclosure provides a cylinder liner that includes a coating on its inner and outer walls to protect the walls from hydrocarbon contamination and to facilitate bonding of the cylinder liner to a cast-in-place engine block.

In one example, which may be combined with or separate from the other examples given herein, a cylinder liner for an internal combustion engine is provided. The cylinder liner includes a main body having a curved interior wall forming a cylinder bore extending along a bore axis and a curved exterior wall formed circumferentially about the curved interior wall. A coating layer is disposed on the interior wall and the exterior wall.

In another example, which may be combined with or separate from the other examples provided herein, a method of forming an engine component is provided. The method includes providing a cylinder liner main body having a curved interior wall forming a cylinder bore extending along a bore axis and a curved exterior wall formed circumferentially about the curved interior wall. The method also includes disposing a coating layer onto the interior wall and the exterior wall to create a coated cylinder liner.

Additional features may be provided, including but not limited to the following: the main body being formed of a first material; the coating layer being formed of a second material; the first and second materials being dissimilar from one another; the second material having a lower melting point than the first material; the first material being formed of a majority of iron; the second material being formed of a majority of aluminum or zinc; the first material being gray cast iron; the second material being an aluminum alloy; the aluminum alloy comprising silicon; the main body further comprising an annular top surface and an annular bottom surface; the coating layer being further disposed on the top surface and the bottom surface; the coating layer covering the entirety of the interior wall, the exterior wall, the top surface, and the bottom surface so that the main body is entirely covered by the coating layer; the coating layer having a thickness in the range of 0.2 to 1.5 millimeters; a top layer disposed on the coating layer; the top layer being formed of a majority of zinc; wherein the step of disposing the coating layer onto the interior wall and the exterior wall comprises hot dipping the cylinder liner main body into a molten bath formed of the second material; wherein the coating layer disposed on the exterior wall defines an outer surface of the coated cylinder liner; casting an engine block over the outer surface of the coated cylinder liner after the step of disposing the coating layer onto the interior wall and the exterior wall; and removing the coating layer from the interior wall after the step of casting the engine block over the outer surface of the coated cylinder liner.

Further areas of applicability of the present disclosure will become apparent from the detailed description provided below. It should be understood that the detailed description and specific examples are intended for purposes of illustration only and are not intended to limit the scope of the disclosure.

BRIEF DESCRIPTION OF THE DRAWINGS

The drawings are provided for illustration purposes only and are not intended to limit the scope of the detailed description or the claims.

DETAILED DESCRIPTION

Figure 1:
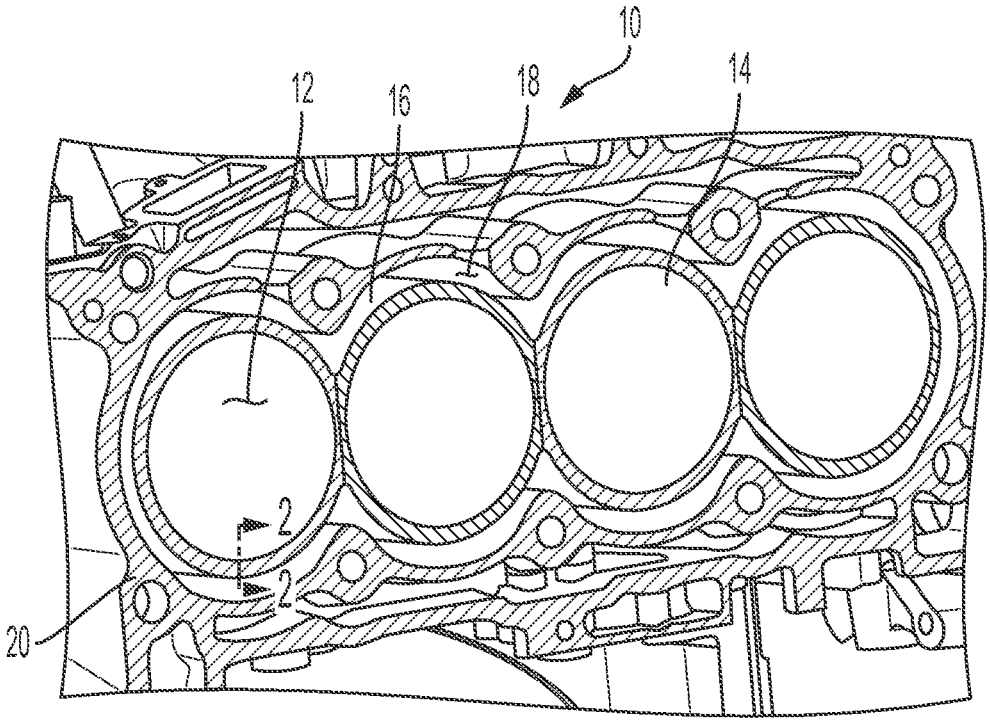
FIG. 1 is a perspective view of an open deck engine block, in accordance with the principles of the present disclosure.

Referring now to the figures, wherein like numbers indicate like elements, FIG. 1 illustrates an open deck engine block 10. The engine block 10 includes a plurality of cylinder bores 12 that are defined by cylinder liners 14 which have been integrated into the engine block 10 during a casting process. In general, these cylinder liners 14 may be positioned into a mold and the molten engine block material, such as, for example, an aluminum alloy, may then be injected into the mold. The molten material then surrounds the cylinder liners 14 as it fills the mold. The material cools to a solid and the liners 14 are firmly bonded to the engine block material 16. In an exemplary process, the casting process may inject the molten engine block material under a high pressure to ensure intimate contact between the engine block material 16 and the cylinder liner 14. The engine block 10 includes a cooling fluid jacket 18 which is exposed to ("open to") the deck surface 20 and is, thus, known as an "open deck" block. The cooling fluid jacket 18 substantially surrounds the cylinder bores 12 and provides fluid communication channels through which cooling fluid may be circulated to remove and manage heat which may be generated during a combustion process during operation of an engine incorporating the engine block 10.

Figure 2:
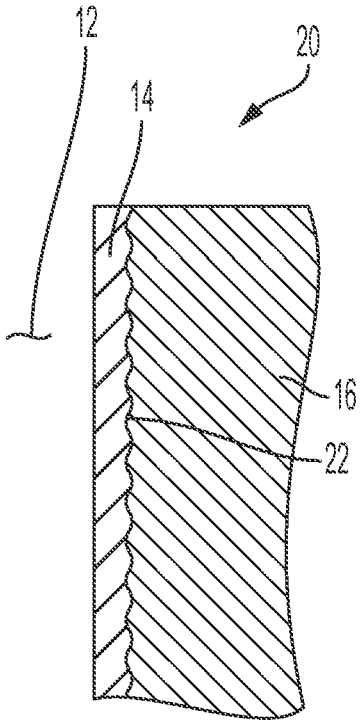
FIG. 2 is a cross-sectional view of a portion of the engine block of FIG. 1, including a cylinder liner, taken along the line 2-2 according to the principles of the present disclosure.

FIG. 2 illustrates a cross-section of a cylinder liner 14 and the surrounding engine block material 16 of the engine block 10 of FIG. 1. The engine block material 16 is bonded to the outer surface 22 of the cylinder liner 14 after the engine block material 16 is cast around the outer surface 22 of the cylinder liner 14.

Figure 3A:
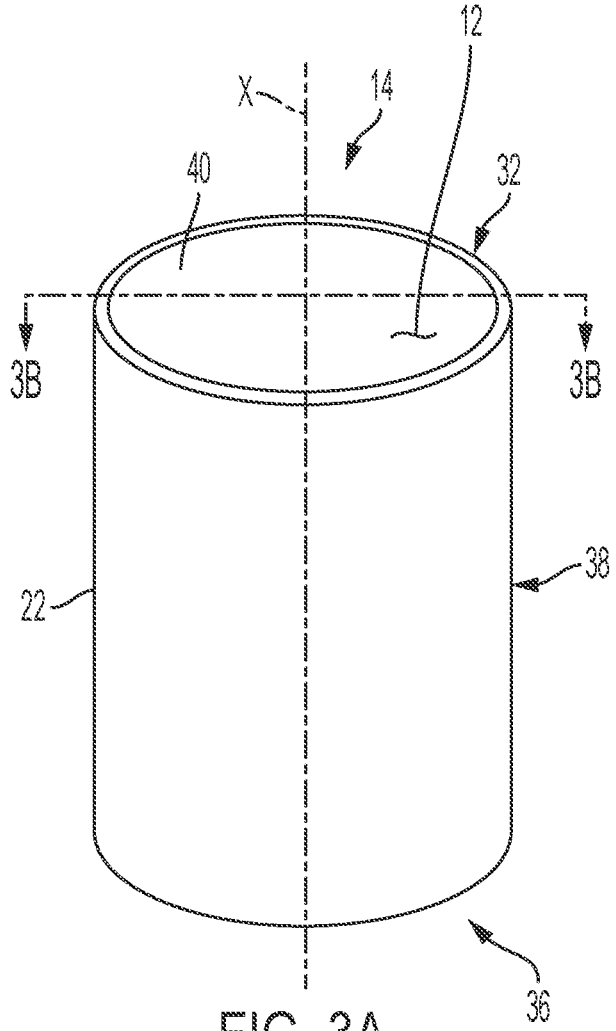
FIG. 3A is a perspective view of the cylinder liner shown in FIG. 2, in accordance with the principles of the present disclosure.
Figure 3B:
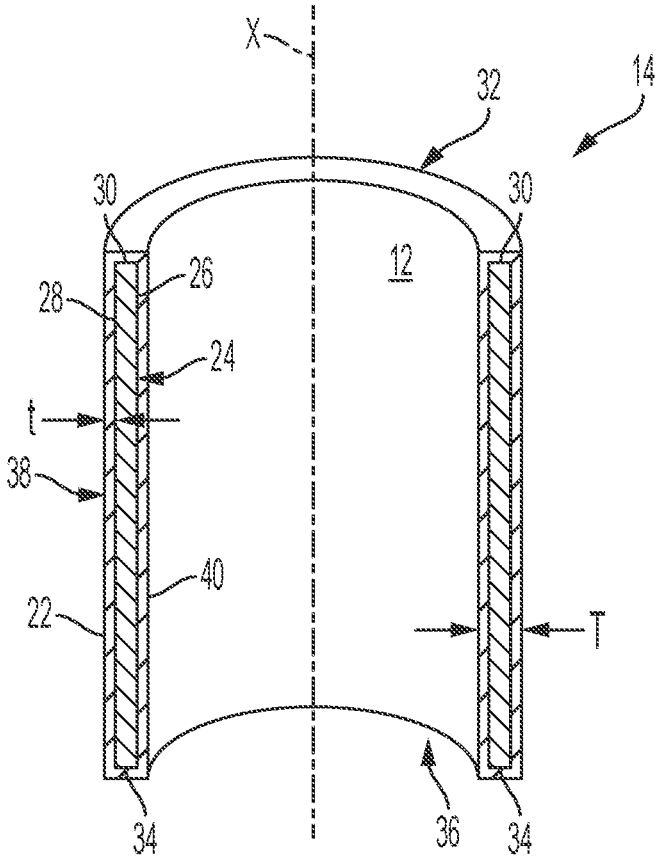
FIG. 3B is a schematic cross-sectional view of the cylinder liner of FIGS. 2 and 3A, according to the principles of the present disclosure.

Referring now to FIGS. 3A and 3B, additional details of the cylinder liner 14 are illustrated. The cylinder liner 14 has a main body 24 having a curved interior wall 26 forming the cylinder bore 12 extending along a bore axis X. The main body 24 also has a curved exterior wall 28 formed circumferentially about the curved interior wall 26. A top annular surface 30 connects the interior and exterior walls 26, 28 at a top end 32 of the main body 24, and a bottom annular surface 34 connects the interior and exterior walls 26, 28 at a bottom end 36 of the main body 24.

A coating layer 38 is disposed on the interior wall 26 and the exterior wall 28 of the main body 24. Thus, the outer surface 22 and an inner surface 40 of the coated cylinder liner 14 is defined by the coating layer 38 that is disposed on the interior and exterior walls 26, 28 of the main body 24. In the illustrated example, the coating layer 38 is also disposed on the top surface 30 and on the bottom surface 34 of the main body 24. Therefore, the coating layer 38 covers the entirety of the interior wall 26, the exterior wall 28, the top surface 30, and the bottom surface 34 of the main body 24 so that the main body 24 is entirely covered by the coating layer 38. The coating layer 38 may have a thickness t in the range of 0.2 to 1.5 millimeters, by way of example. The total thickness T of the cylinder liner 14 could be, for example, 3 to 7 millimeters, or 4.5 to 7 millimeters, by way of example, for cast-in-place cylinder liners 14. In the alternative, the cylinder liner 14 could be a press-in-place cylinder liner 14 that is pressed into an already-cast engine block, in which case the cylinder liner could be thinner, such as in the range of 1-3 millimeters, by way of example.

The main body 24 may be formed of a first material, while the coating layer 38 may be formed of a second material. The first and second materials may be dissimilar from one another. For example, the second material may have a lower melting point than the first material. In one example, the first material is formed of a majority of iron, such as gray cast iron. The second material may be formed of a majority of aluminum or a majority of zinc. Thus, the coating layer 38 may be formed of an aluminum alloy or of a zinc alloy that is disposed on the cast iron main body 24. In one example, the coating layer 38 is formed of an aluminum alloy containing silicon, such as an AlSi12 eutectic alloy. Other aluminum alloys suitable for the coating layer 38 may contain copper, silicon, and/or magnesium, by way of example. Any cast aluminum alloys could be used, such as 300 series or 600 series aluminum alloys. If formed of a zinc alloy, the coating layer 38 could be formed of a majority of zinc along with alloying elements, such as aluminum, copper, magnesium, and/or manganese, by way of example.

In an example, the melting point of the coating layer 38 could be in the range of 580-650 degrees Celsius (such as when the coating layer 38 is formed of an AlSi12 eutectic alloy), while the melting point of the main body 24 could be more than 1100 degrees Celsius, more than 1300 degrees Celsius, or more than 1500 degrees Celsius. If gray cast iron is used for the main body 24, the melting point would typically be in the range of 1150-1200 degrees Celsius.

The coating layer 38 protects the main body 24 from hydrogen contamination during storing and shipping. The coating layer 38 may provide a rust-proofing for the main body 24 so that traditional VCI bags and desiccant packaging materials can be eliminated or reduced. It is advantageous to protect all surfaces of the main body 24 prior to over-casting the engine block material 16 (typically an aluminum alloy) onto the exterior wall 28 of the main body 24 because hydrogen contamination may interfere with adhesion and/or intermetallic bonding between the engine block materials 16 and the outer surface 22 of the cylinder liner 14 and hydrogen contamination through any of the main body surfaces 26, 28, 30, 34 may permeate through the main body 24 and affect the bonding between the engine block materials 16 and the cylinder liner 14. For example, if hydrocarbon contamination were to occur, the hydrogen may diffuse out of the cylinder liner body 24 and form bubbles that cause porosity at bonding interfaces, for example, at the top surface 30 that bonds with aluminum near the deck face 20.

In addition to protecting the cylinder liner 14 from hydrogen contamination, the coating layer 38 also facilitates bonding between the cylinder liner 14 and the engine block materials 16, because the alloy of the coating layer 38 bonds to the engine block materials 16 better than the exterior wall 28 of the main body 24 would bond to the engine block materials 16 without the coating layer 38 disposed thereon. More particularly, the coating layer 38 and the exterior wall 28 of the main body 24 may form a 1-500 μm thick transition layer containing FeAl compounds, which provide a good base for metallurgical bonding between the engine block materials 16 and the outer surface 22 of the cylinder liner 14.

Figure 4:
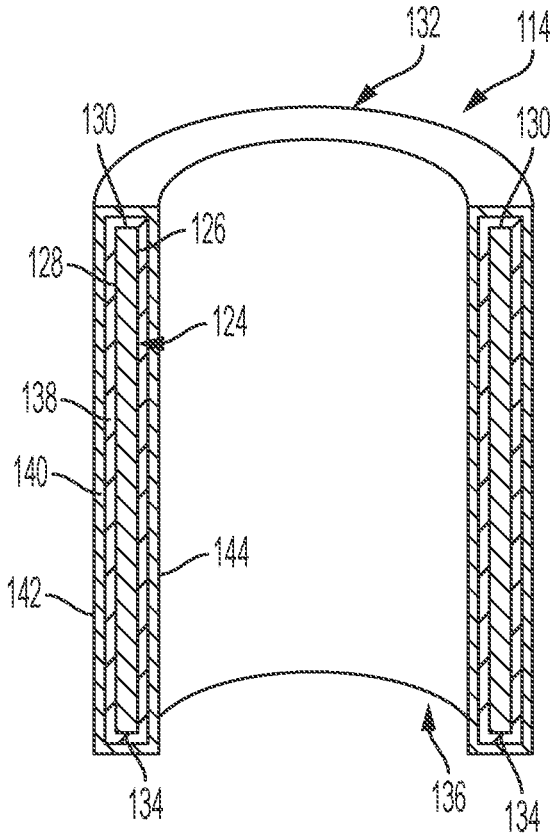
FIG. 4 is a schematic cross-sectional view of another variation of a cylinder liner, in accordance with the principles of the present disclosure.

Referring now to FIG. 4, another variation of a cylinder liner is illustrated and generally indicated at 114. It should be understood that the cylinder liner 114 could be used in place of the cylinder liner 14, and the cylinder liner 114 may be the same as the cylinder liner 14 except where described differently. For example, the cylinder liner 114 has a main body 124 like the main body 24 of the cylinder liner 14, which may be formed of a material containing a majority of iron, such as gray cast iron. The main body 124 has an interior wall 126, an exterior wall 128 formed circumferentially about the interior wall 126, an annular top surface 130 connecting the interior and exterior walls 126, 128 at a top end 132, and an annular bottom surface 134 connecting the interior and exterior walls 126, 128 at a bottom end 136.

The cylinder liner 124 has a first coating layer 138 disposed on the interior wall 126, the exterior wall 128, the top surface 130, and the bottom surface 134 of the main body 124. Therefore, the coating layer 138 covers the entirety of the interior wall 126, the exterior wall 128, the top surface 130, and the bottom surface 134 so that the main body 124 is entirely covered by the coating layer 138. The coating layer 138 is formed of an aluminum alloy, such as an AlSi12 eutectic alloy, or any other aluminum alloy, such as those described above, which contain a majority of aluminum.

A top layer 140 is disposed on the coating layer 138. The top layer 140 may be formed of a majority of zinc to provide for additional protection against corrosion. Thus, an outer surface 142 and an inner surface 144 of the cylinder liner 114 is defined by the top layer 140 that is disposed on the coating layer 138 of the cylinder liner 114. Zinc alloys that may be used in the top layer 140 contain a majority of zinc, with alloying elements such as copper, aluminum, magnesium, and/or manganese, by way of example.

Figure 5:
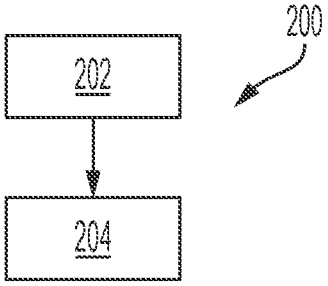
FIG. 5 is a block diagram illustrating a method of forming an engine component, such as the engine block and/or the cylinder liner of FIGS. 1-4, in accordance with the principles of the present disclosure.

Referring now to FIG. 5, a block diagram illustrating a method of forming an engine component is illustrated and generally designated at 200. The method 200 includes a step 202 of providing a cylinder liner main body having a curved interior wall forming a cylinder bore extending along a bore axis and a curved exterior wall formed circumferentially about the curved interior wall. The method 200 further includes a step 204 of disposing a coating layer onto the interior wall and the exterior wall to create a coated cylinder liner.

Additional steps, sub-steps, or details may also be included in the method 200. For example, in an advantageous example, the step 204 of disposing the coating layer onto the interior wall and the exterior wall includes hot dipping the cylinder liner main body into a molten bath formed of the coating layer material. In one example, as described above, the main body of the cylinder liner is formed of gray cast iron. The molten bath may be formed of an aluminum alloy, such as those described above, and the step 204 of applying the coating layer may include hot dipping the entire main body into the molten bath to coat all surfaces of the main body with the coating layer.

Figure 6:
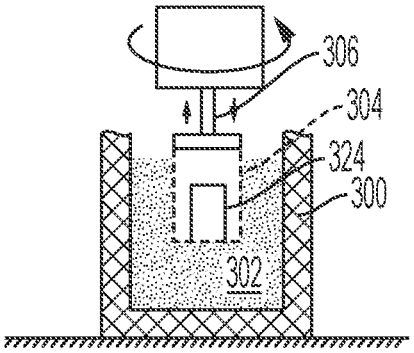
FIG. 6 is a schematic cross-sectional view of a cylinder liner being dipped into a molten bath, in accordance with a variation of the method of FIG. 5.

Referring to FIG. 6, one example of a hot dipping process for coating the cylinder liner is illustrated. A crucible 300 containing a molten aluminum alloy bath 302 is provided, and a fixture 304 holding a cylinder liner main body 324 is lowered into the molten aluminum alloy bath 302. The fixture 304 and the main body 324 may be rotated, for example, via shaft 306, to apply centrifugal forces during the dipping process. In addition, the fixture 304 and the main body 324 may be vibrated with an ultrasonic vibration. The centrifugal and/or vibrational forces provide for a more dense and uniform coating. In one example, the main body 324 may be rotated at a speed in the range of 200-500 rpm. The main body 324 may be vibrated at an ultrasonic frequency in the range of 20-30,000 Hz, or 1000-30,000 Hz, by way of example.

In one example, a process for creating an engine component may include machining and shot blasting the main body of a cylinder liner prior to dip coating the main body in the molten aluminum alloy bath 302 (or other material molten bath). The main body of the cylinder liner may also be preheated prior to dipping it into the bath, such as preheating to a temperature between 400 and 600 degrees Celsius, or in another example, to a temperature of at least 500 degrees Celsius. The main body may be dipped for a time period such as 1-10 minutes to achieve a desired thickness level of the coating, such as 0.2-1.5 mm. A resultant compound layer may be created between the coating layer and the main body, where the compound layer contains FeAl compounds, such as $Fe_2Al_5$.

As an alternative to applying the coating layers 38, 138, 140 via hot dipping, the coating layers 38, 138, 140 could be applied in any other suitable way, such as by thermal spraying.

After the hot dipping or other coating process is complete, the method 200 may include an additional step of casting the cylinder liner 14, 114 into an engine block. For example, the method 200 may include casting an engine block over the outer surface of the coating layer after the step 204 of disposing the coating layer onto the interior wall and the exterior wall of the main body to create the coated cylinder liner.

The coating layer may be removed from the interior wall of the main body of the cylinder liner. Preferably, the coating layer is left on the interior wall until after the casting of the engine block materials onto the outer surface, which provides the benefit of preventing hydrogen contamination that interferes with the bonding to the engine block materials 16 that are cast onto the outer surface of the coated cylinder liner. Thus, the method 200 may include removing the coating layer from the interior wall after the step of casting the engine block over the exterior wall, for example, through a machining operation. The interior wall may then be honed to add desirable surface features, such as roughness and/or grooves or other profile features.

This description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A cylinder liner for an internal combustion engine, the cylinder liner comprising:

a main body having a curved interior wall forming a cylinder bore extending along a bore axis and a curved exterior wall formed circumferentially about the curved interior wall; and a coating layer disposed on the interior wall and the exterior wall, the main body being formed of a first material, the first material being gray cast iron, and the coating layer being formed of a second material, the second material being an aluminum alloy comprising silicon, further comprising a top layer disposed on the coating layer, the top layer being formed of a majority of zinc.

2. A method of forming an engine component, the method comprising:

providing a cylinder liner main body having a curved interior wall forming a cylinder bore extending along a bore axis and a curved exterior wall formed circumferentially about the curved interior wall and forming the cylinder liner main body of a first material;

disposing a coating layer onto the interior wall and the exterior wall to create a coated cylinder liner and providing the coating layer as being formed of a second material, the first and second materials being dissimilar from one another, wherein the step of disposing the coating layer onto the interior wall and the exterior wall comprises hot dipping the cylinder liner main body into a molten bath formed of the second material, and wherein the coating layer disposed on the exterior wall defines an outer surface of the coated cylinder liner;

casting an engine block over the outer surface of the coated cylinder liner after the step of disposing the coating layer onto the interior wall and the exterior wall; and removing the coating layer from the interior wall after the step of casting the engine block over the outer surface.

3. The method of claim 2, further comprising providing the second material as having a lower melting point than the first material.

4. The method of claim 3, further comprising providing the first material as being formed of a majority of iron, and providing the second material being formed of a majority of aluminum or zinc.

5. The method of claim 4, further comprising providing the first material as gray cast iron, and providing the second material as an aluminum alloy comprising silicon.

6. The method of claim 2, further comprising:

providing the main body cylinder liner having an annular top surface and an annular bottom surface; and disposing the coating layer on the top surface and the bottom surface, the coating layer covering the entirety of the interior wall, the exterior wall, the top surface, and the bottom surface so that the main body is entirely covered by the coating layer.

7. The method of claim 6, further comprising providing the coating layer having a thickness in the range of 0.2 to 1.5 millimeters.

8. The method of claim 6, further comprising disposing a top layer on the coating layer, the top layer being formed of a majority of zinc.

* * * * *